US009224399B2

(12) United States Patent
Sung et al.

(10) Patent No.: US 9,224,399 B2
(45) Date of Patent: Dec. 29, 2015

(54) APPARATUS AND METHOD FOR CONCEALING FRAME ERASURE AND VOICE DECODING APPARATUS AND METHOD USING THE SAME

(71) Applicant: Samsung Electronics Co., Ltd., Suwon-si (KR)

(72) Inventors: Hosang Sung, Yongin-si (KR); Kangeun Lee, Gangneung-si (KR); Seungho Choi, Seoul (KR)

(73) Assignee: SAMSUNG ELECTRONCIS CO., LTD., Suwon-si (KR)

( * ) Notice: Subject to any disclaimer, the term of this patent is extended or adjusted under 35 U.S.C. 154(b) by 0 days.

(21) Appl. No.: 13/916,835

(22) Filed: Jun. 13, 2013

(65) Prior Publication Data

US 2013/0275127 A1 Oct. 17, 2013

Related U.S. Application Data

(63) Continuation of application No. 13/477,461, filed on May 22, 2012, now Pat. No. 8,498,861, and a continuation of application No. 11/417,165, filed on May 4, 2006, now Pat. No. 8,204,743.

(30) Foreign Application Priority Data

Jul. 27, 2005 (KR) ..... 10-2005-0068541

(51) Int. Cl.

| | |
|---|---|
| ***G10L 11/06*** | (2006.01) |
| ***G10L 19/005*** | (2013.01) |
| *G10L 19/06* | (2013.01) |
| *G10L 19/083* | (2013.01) |

(52) U.S. Cl.

CPC ..... *G10L 19/005* (2013.01); *G10L 19/06* (2013.01); *G10L 19/083* (2013.01)

(58) Field of Classification Search

CPC ..... G10L 19/005; G10L 19/04; G10L 19/06; G10L 19/07; G10L 25/03

USPC ..... 704/208, 205, 215, 225

See application file for complete search history.

(56) References Cited

U.S. PATENT DOCUMENTS 6,085,158 A 7/2000 Naka et al.
6,157,830 A 12/2000 Minde et al.

(Continued)

FOREIGN PATENT DOCUMENTS

KR 10-2004-0090567 10/2004

OTHER PUBLICATIONS

U.S. Office Action mailed Aug. 23, 2013 in related U.S. Appl. No. 13/477,461.

(Continued)

*Primary Examiner* — Jakieda Jackson

(74) *Attorney, Agent, or Firm* — Sughrue Mion, PLLC

(57) ABSTRACT

An apparatus and method for concealing frame erasure and a voice decoding apparatus and method using the same. The frame erasure concealment apparatus includes: a parameter extraction unit determining whether there is an erased frame in a voice packet, and extracting an excitement signal parameter and a line spectrum pair parameter of a previous good frame; and an erasure frame concealment unit, if there is an erased frame, restoring the excitement signal and line spectrum pair parameter of the erased frame by using a regression analysis from the excitement signal and line spectrum pair parameter of the previous good frame. According to the method and apparatus, by predicting and restoring the parameter of the erased frame through the regression analysis, the quality of the restored voice signal can be enhanced and the algorithm can be simplified.

2 Claims, 6 Drawing Sheets

(56) References Cited

U.S. PATENT DOCUMENTS

| | | | | |
|---|---|---|---|---|
| 6,201,960 | B1 * | 3/2001 | Minde et al. | 455/424 |
| 6,691,090 | B1 | 2/2004 | Laurila et al. | |
| 6,714,908 | B1 * | 3/2004 | Naka | 704/228 |
| 6,721,327 | B1 | 4/2004 | Ekudden et al. | |
| 6,775,649 | B1 | 8/2004 | DeMartin | |
| 6,810,377 | B1 * | 10/2004 | Ho et al. | 704/208 |
| 6,826,527 | B1 | 11/2004 | Unno | |
| 7,035,797 | B2 | 4/2006 | Iso-Sipila | |
| 7,043,030 | B1 | 5/2006 | Furuta | |
| 8,712,765 | B2 * | 4/2014 | Ehara | 704/219 |
| 2003/0074197 | A1 | 4/2003 | Chen | |
| 2003/0078769 | A1 * | 4/2003 | Chen | 704/211 |
| 2003/0083865 | A1 * | 5/2003 | Thyssen | 704/205 |
| 2005/0154584 | A1 * | 7/2005 | Jelinek et al. | 704/219 |
| 2005/0267741 | A1 | 12/2005 | Laaksonen | |
| 2006/0222172 | A1 | 10/2006 | Chhetri et al. | |
| 2007/0220340 | A1 | 9/2007 | Whisnant et al. | |
| 2007/0239462 | A1 * | 10/2007 | Makinen et al. | 704/500 |
| 2012/0072214 | A1 * | 3/2012 | Cox et al. | 704/236 |

OTHER PUBLICATIONS

U.S. Appl. No. 13/477,461, filed May 22, 2012, Hosang Sung, Samsung Electronics Co., Ltd.

U.S. Appl. No. 11/417,165, filed May 4, 2006, Hosang Sung, Samsung Electronics Co., Ltd.

Lee et al., A forward-backward voice packet loss concealment algorithm for multimedia over IP network services 2004, Springer-Verlag Berlin Heidelberg, pp. 381-388.

U.S. Notice of Allowance mailed Mar. 13, 2013 in related U.S. Appl. No. 13/477,461.

U.S. Office Action mailed Aug. 23, 2012 in related U.S. Appl. No. 13/477,461.

U.S. Notice of Allowance mailed Feb. 23, 2013 in related U.S. Appl. No. 11/417,165.

U.S. Office Action mailed Sep. 30, 2011 in related U.S. Appl. No. 11/417,165.

U.S. Office Action mailed Apr. 15, 2013 in related U.S. Appl. No. 11/417,165.

U.S. Office Action mailed Aug. 24, 2010 in related U.S. Appl. No. 11/417,165.

U.S. Advisory Action mailed May 27, 2010 in related U.S. Appl. No. 11/417,165.

U.S. Office Action mailed Mar. 19, 2010 in related U.S. Appl. No. 11/417,165.

U.S. Office Action mailed Sep. 9, 2009 in related U.S. Appl. No. 11/417,165.

U.S. Office Action mailed Jan. 7, 2009 in related U.S. Appl. No. 11/417,165.

* cited by examiner

APPARATUS AND METHOD FOR CONCEALING FRAME ERASURE AND VOICE DECODING APPARATUS AND METHOD USING THE SAME

CROSS-REFERENCE TO RELATED APPLICATION

This application is a continuation of U.S. application Ser. No. 13/477,461 filed May 22, 2012, which is a continuation of Ser. No. 11/417,165 filed May 4, 2006, which claims the benefit of Korean Patent Application No. 10-2005-0068541, filed on Jul. 27, 2005, in the Korean Intellectual Property Office, the disclosures of which are incorporated by reference herein in their entirety.

BACKGROUND

1. Field of the Invention

The present invention relates to voice decoding, and more particularly, to an apparatus and method for concealing frame erasure by which a voice signal can be restored with concealing frame erasure by using regression analysis when voice decoding is performed, and a voice decoding apparatus and method using the same.

2. Description of Related Art

In order to enable data transmission even under a transmission environment in which a bandwidth is limited, instead of directly transmitting a voice signal, recent voice encoding apparatuses extract parameters representing a voice signal, encode the extracted parameters, and generate a bitstream including the encoded parameters. A voice decoding apparatus decodes parameters included in the received bitstream, and by using the decoded parameters, generates a restored voice signal.

The conventional voice decoding apparatus uses a method based on correlation of a voice signal adjacent to an erased frame that occurs in a received packet in order to conceal the erased frame. Algorithms based on an extrapolation method in which parameters of a previous good frame are used to obtain the parameters of the erased frame, and an interpolation method in which parameters of a next good frame are used to obtain the parameters of the erased frame are mainly used. However, since the erased frame lowers the sound quality by the erased interval, and in addition damages long interval prediction memory data, errors are propagated, even to the following frames. As a result, even though the voice reception apparatus again receives valid packets after losing packets, the sound degradation continues because of the use of damaged data stored in the long interval prediction memory. Accordingly, there is a limit in solving this sound quality degradation and error propagation problems with the conventional algorithm.

Meanwhile, the concealment algorithm of ITU-T G.729 that is widely used in the voice over Internet protocol (VoIP) application fields together with G. 723.1, obtains spectrum information and excitement signal information of voice by using code excited linear prediction (CELP) algorithm based on a spoken voice model. When the CELP algorithm is applied, the voice encoding parameters of an erased frame are estimated by using the excitement signal and spectrum information of a most recent good frame. In this process, the energy of the excitement signal corresponding to the erased frame is gradually reduced so that its effect on packet loss can be minimized. However, the reducing of the energy of the excitement signal results in degradation of the sound quality.

BRIEF SUMMARY

An aspect of the present invention provides an apparatus and method for concealing frame erasure by which a voice signal can be restored with concealing frame erasure by using regression analysis when voice decoding is performed, and a voice decoding apparatus and method using the same.

According to an aspect of the present invention, there is provided an apparatus for concealing frame erasure including: a parameter extraction unit determining whether there is an erased frame in a voice packet, and extracting an excitement signal parameter and a line spectrum pair parameter of a previous good frame; and a frame erasure concealment unit restoring an excitement signal and a line spectrum pair parameter of an erased frame by using a regression analysis from the excitement signal parameter and the line spectrum pair parameter of the previous good frame, when there is an erased frame.

The regression analysis may be performed by deriving a linear function from parameters of the previous good frame. As another method, the regression analysis may be performed by deriving a nonlinear function from parameters of the previous good frame. As used in this disclosure, the "nonlinear function" means all functions except a $1^{st}$ order linear function. For example, trigonometric functions, exponential functions, inverse functions or higher order polynomial functions are possible.

The frame erasure concealment unit may include: an excitement signal restoration unit restoring the excitement signal of the erased frame by using a regression analysis from the excitement signal parameter of the previous good frame; and a line spectrum pair restoration unit restoring the line spectrum pair parameter of the erased frame by using a regression analysis from the line spectrum pair parameter of the previous good frame.

The excitement signal restoration unit may include: a first function derivation unit deriving a function by the regression analysis by using the gain parameters of the previous good frame; and a first parameter prediction unit predicting the gain parameter of the erased frame by the derived function and providing the predicted gain parameter as the gain parameter of the erased parameter.

The excitement signal restoration unit further may include a gain control unit controlling the gain parameter according to the degree of voiced content of the previous good frame.

The line spectrum pair restoration unit may include: a first transform unit transforming the line spectrum pair parameter of the previous good frame into a spectrum parameter; a second function derivation unit deriving a function by a regression analysis by using the spectrum parameter; a second parameter prediction unit predicting the spectrum parameter of the erased frame by the derived function; and a second transform unit transforming the predicted spectrum parameter to a line spectrum pair parameter and providing the line spectrum pair parameter as the line spectrum pair parameter of the erased frame.

According to another aspect of the present invention, there is provided a method of concealing frame erasure including: determining whether there is an erased frame in a voice packet, and extracting an excitement signal parameter and a line spectrum pair parameter of a previous good frame; and restoring parameters of an erased frame by using a regression analysis from the extracted parameters of the previous good frame, when there is an erased frame.

According to still another aspect of the present invention, there is provided an apparatus for decoding an encoded voice packet to a voice signal including: a parameter extraction unit determining whether there is an erased frame in a voice packet, and extracting an excitement signal parameter and a line spectrum pair parameter of a previous good frame; an excitement signal decoding unit decoding a parameter of an excitement signal of a current frame and outputting the excitement signal, when there is no erased frame; a line spectrum parameter decoding unit decoding a line spectrum pair parameter of the current frame and outputting the line spectrum pair parameter, when there is no erased frame; a frame erasure concealment unit restoring an excitement signal and a line spectrum pair parameter of an erased frame by using a regression analysis from the excitement signal parameter and line spectrum pair parameter of the previous good frame, when there is an erased frame; and a synthesis filter outputting a voice signal synthesized from either the restored excitement signal and the restored line spectrum pair parameter or the output excitement signal and the output line spectrum pair parameter.

According to yet still another aspect of the present invention, there is provided a method of decoding an encoded voice packet to a voice signal including: determining whether there is an erased frame in a voice packet, and extracting an excitement signal parameter and a line spectrum pair parameter of a previous good frame; decoding a parameter of an excitement signal of a current frame and outputting the excitement signal, when there is no erased frame; decoding a line spectrum pair parameter of the current frame and outputting the line spectrum pair parameter, when there is no erased frame; restoring an excitement signal and a line spectrum pair parameter of an erased frame by using a regression analysis from the excitement signal parameter and line spectrum pair parameter of the previous good frame, when there is an erased frame; and outputting a voice signal synthesized from either the restored excitement signal and the restored line spectrum pair parameter or the output excitement signal and output line spectrum pair parameter.

According to another aspect of the present invention, there are provided computer-readable storage media encoded with processing instructions for causing a processor to execute the aforementioned methods.

Additional and/or other aspects and advantages of the present invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1:
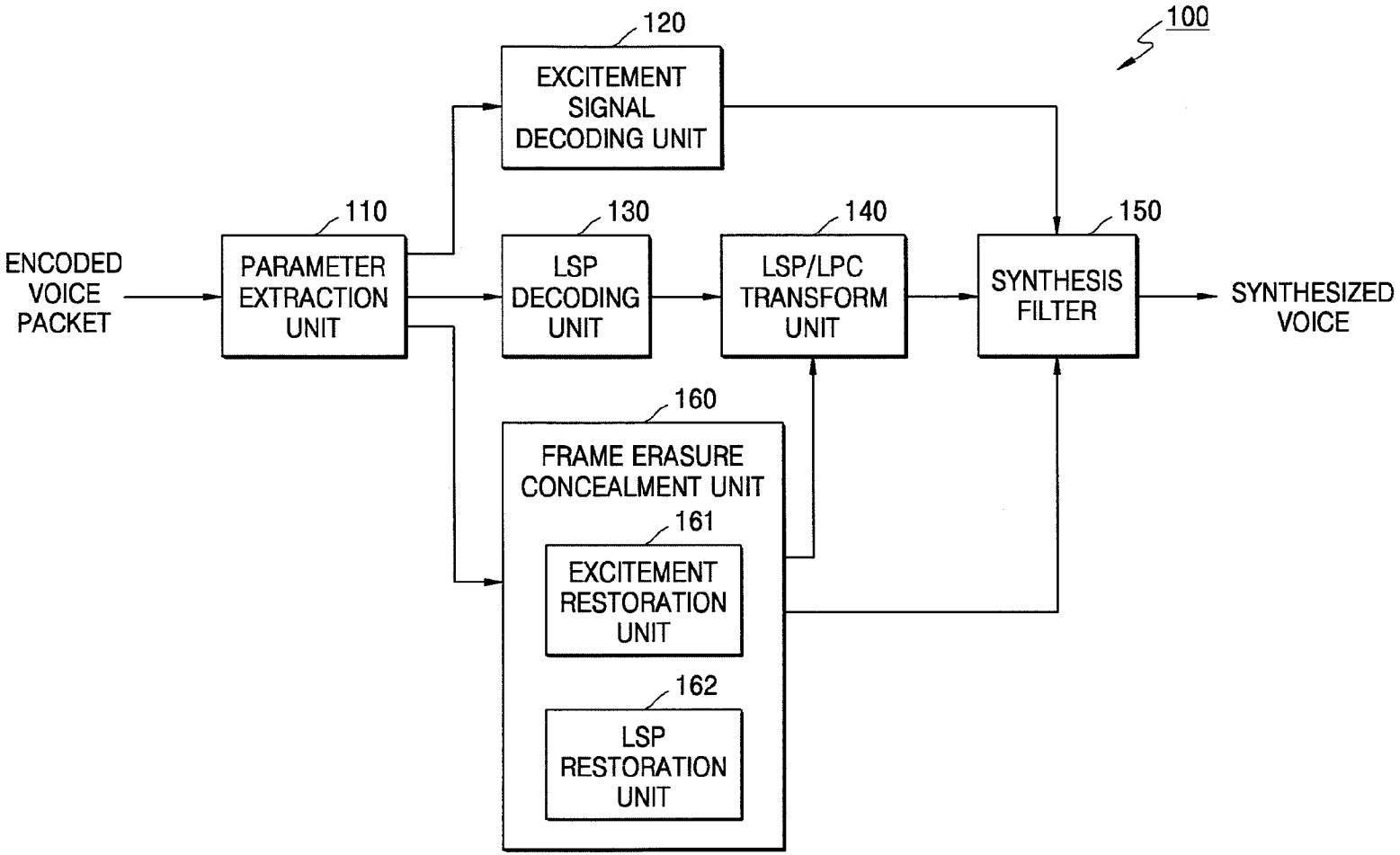
FIG. 1 is a block diagram of the structure of a voice decoding apparatus including a frame erasure concealment apparatus according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a block diagram of the structure of a voice decoding apparatus including a frame erasure concealment apparatus according to an embodiment of the present invention. Referring to FIG. 1, the voice decoding apparatus 100 includes a parameter extraction unit 110, an excitement signal decoding unit 120, a line spectrum pair (LSP) decoding unit 130, an LSP/linear prediction coefficient (LPC) transform unit 140, a synthesis filter 150, and a frame erasure concealment unit 160. For ease of explanation only, the operation of the voice decoding apparatus 100 shown in FIG. 1 will now be explained with reference to a voice decoding method using frame erasure concealment according to an embodiment of the present invention shown in FIG. 5.

Figure 5:
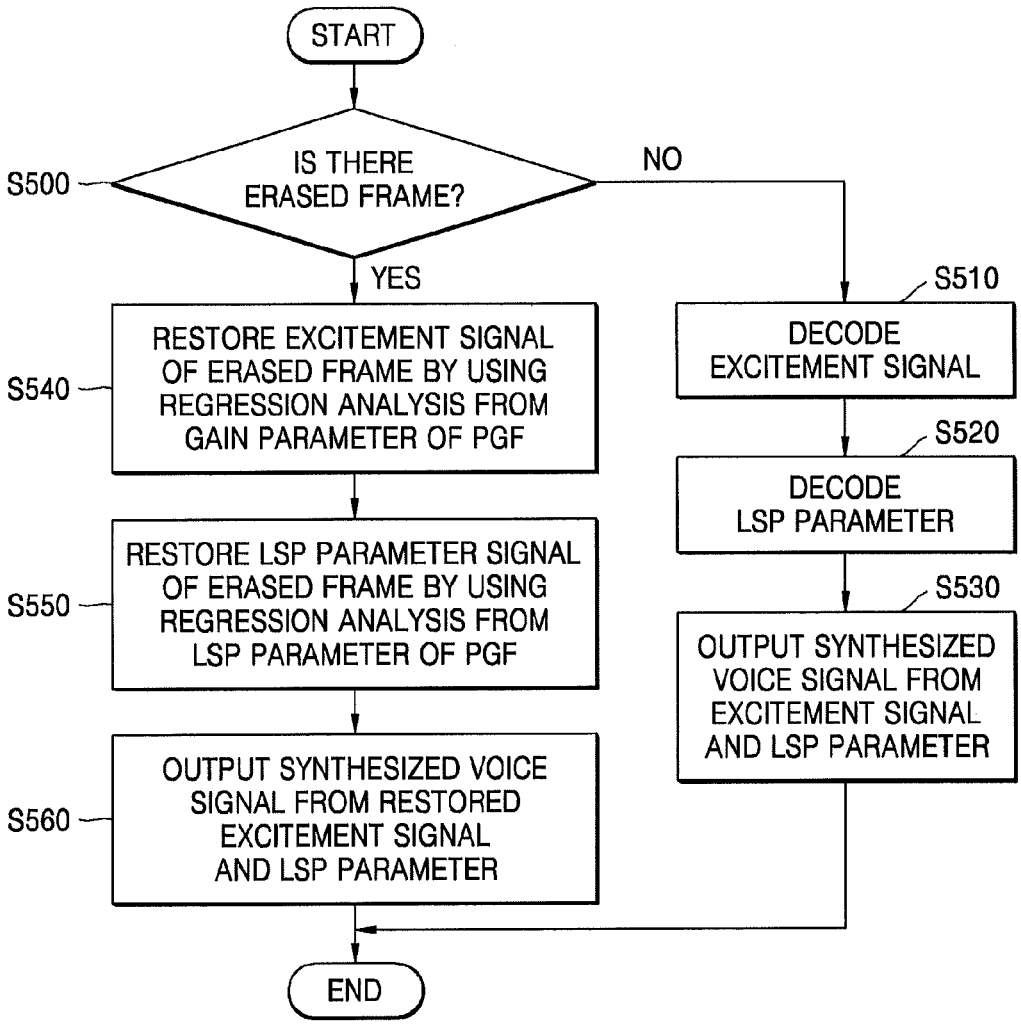
FIG. 5 is a flowchart of a voice decoding method using frame erasure concealment according to an embodiment of the present invention.

Referring to FIGS. 1 and 5, an encoded voice packet input to the parameter extraction unit 110 is a packet for which error inspection is performed. Accordingly, in the input encoded voice packet a frame in which an error occurred is already erased.

The parameter extraction unit 110 determines the presence of an erased frame by checking the input encoded voice packet in units of frames, and according to the determination result, extracts and outputs parameters included in the voice packet in operation S500. If it is determined that a packet is erased by a bitstream error or if a packet is not received for a predetermined time, the parameter extraction unit 110 can determine that the frame of the interval not received is erased.

If the input encoded voice packet is a good frame, the parameter extraction unit 110 extracts parameters required to decode an excitement signal, among parameters included in the received voice packet, outputs the parameters to the excitement signal decoding unit 120, and outputs an LSP parameter (or LSP coefficient) having 10 roots to the LSP decoding unit 130.

If the voice decoding apparatus a code-excited linear prediction (CELP) type, the parameter required to decode the excitement signal may include a pitch used in an adaptive codebook, a codebook index used in a fixed codebook, a gain value ($g_p$) of the adaptive codebook and a gain value ($g_p$) of the fixed codebook. In the present embodiment of the present invention, gain parameters corresponding to the gain value ($g_p$) of the adaptive codebook and the gain value ($g_p$) of the fixed codebook are used.

The excitement signal decoding unit 120 decodes the input parameters and outputs the excitement signal in operation S510. The output excitement signal is transmitted to the synthesis filter 150.

The LSP decoding unit 130 decodes the input LSP parameter in operation S520. The decoded LSP parameter is transmitted to the LSP/LPC transform unit 140. The LSP/LPC transform unit 140 transforms the decoded LSP parameter into an LPC parameter. The transformed LPC parameter is transmitted to the synthesis filter 150.

The synthesis filter 150 performs synthesis filtering of the excitement signal by using the LPC parameter and outputs a synthesized voice signal in operation S530. The synthesized voice signal is a restored voice signal.

However, if it is determined that the frame is erased, in order to restore the LSP parameter of the erased frame (or damaged frame), the parameter extraction unit 110 outputs parameters capable of restoring the LSP parameter and excitement signal of a previous good frame (PGF), to the frame erasure concealment unit 160.

The frame erasure concealment unit 160 can restore the excitement signal and LSP parameter of the erased frame by an extrapolation method. The frame erasure concealment unit 160 includes an excitement signal restoration unit 161 and an LSP restoration unit 162.

The excitement signal restoration unit 161 receives parameters for generating the excitement signal of a PGF transmitted from the parameter extraction unit 110, and by using the received parameters, restores the excitement signal of the erased frame in operation S540. The restored excitement signal is transmitted to the synthesis filter 150. The excitement signal restoration unit 161 will be explained later in detail with reference to FIG. 2.

The LSP restoration unit 162 restores the linear spectrum pair parameter of the erased frame by using a regression analysis from the linear spectrum pair parameter of the PGF in operation S550. The LSP restoration unit 162 will be explained in detail with reference to FIG. 3.

The synthesis filter 150 outputs a voice signal synthesized from the restored excitement signal and LPC parameter in operation S560.

Figure 2:
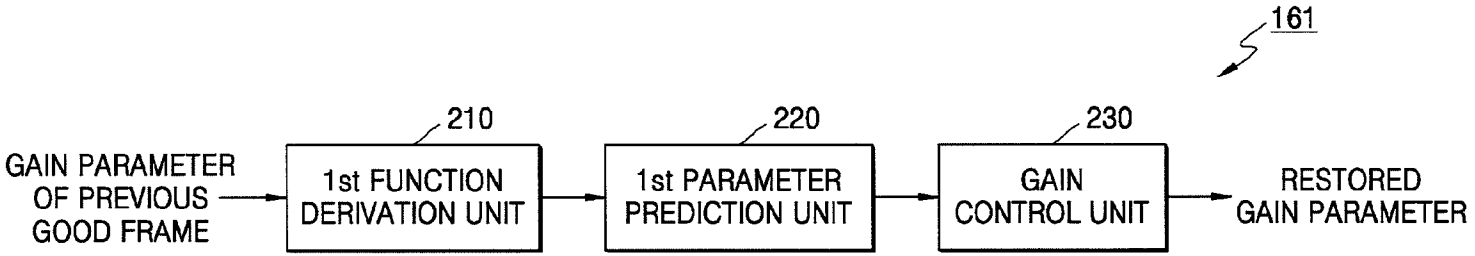
FIG. 2 is a detailed block diagram of the structure of the excitement signal restoration unit of FIG. 1.

FIG. 2 is a detailed block diagram of the structure of the excitement signal restoration unit 161 of FIG. 1.

Referring to FIG. 2, the excitement signal restoration unit 161 includes a first function derivation unit 210, a first parameter prediction unit 220, and a gain control unit 230.

Figure 6:
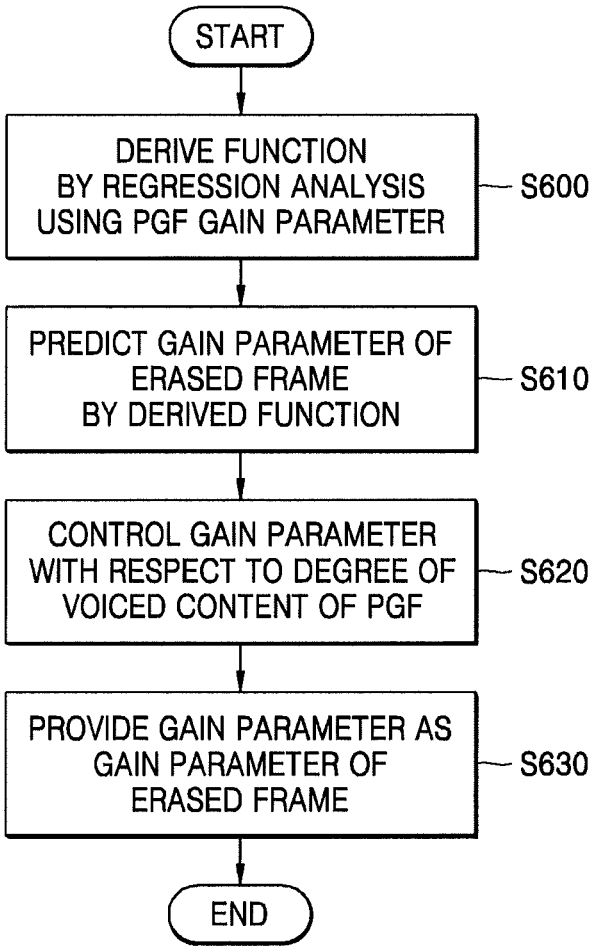
FIG. 6 is a detailed flowchart of the operation for restoring an excitement signal shown in FIG. 5.

The operation of the excitement signal unit 161 shown in FIG. 2 will be explained with reference to a detailed flowchart showing the operation of restoring an excitement signal shown in FIG. 6.

The first function derivation unit 210 derives a function by a regression analysis from the gain parameter of a PGF in operation S600. This function may be a linear or nonlinear one. The nonlinear function may be an exponential function, a log function, or a quadric polynomial or a polynomial of a higher order. One frame has two or more adaptive codebook gain values ($g_p$) and fixed codebook gain values (gp). That is, one frame has two or more subframes and each subframe has an adaptive codebook gain value ($g_p$) and a fixed codebook gain value (9*c*). Accordingly, by using gain parameter values of respective subframe, a function is derived through a regression analysis.

Figure 4A:
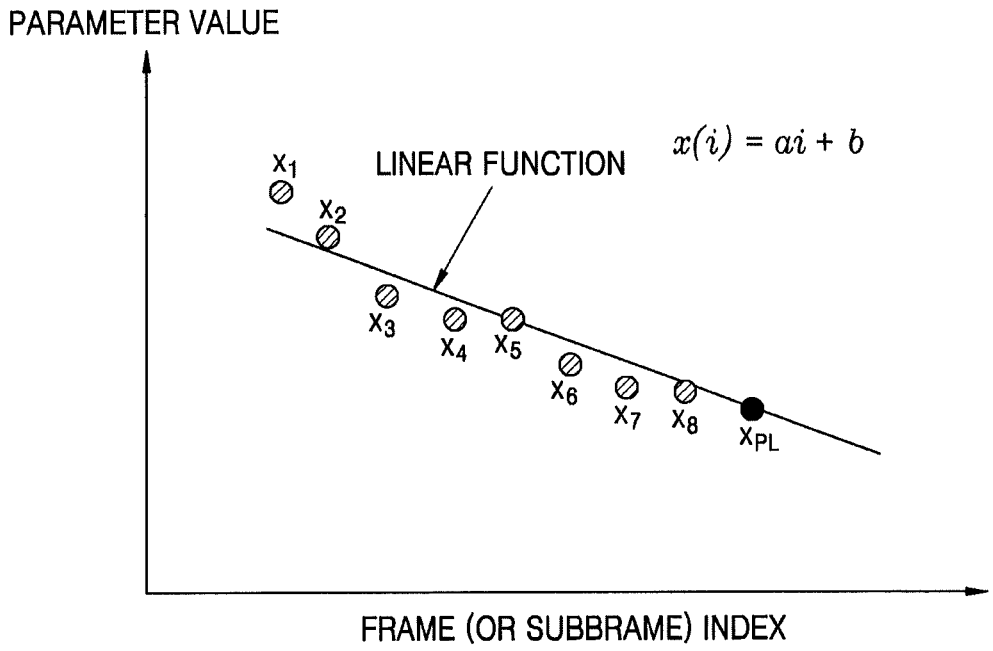
FIG. 4A illustrates a graph showing an example of a function derived by a linear regression analysis according to an embodiment of the present invention.
Figure 4B:
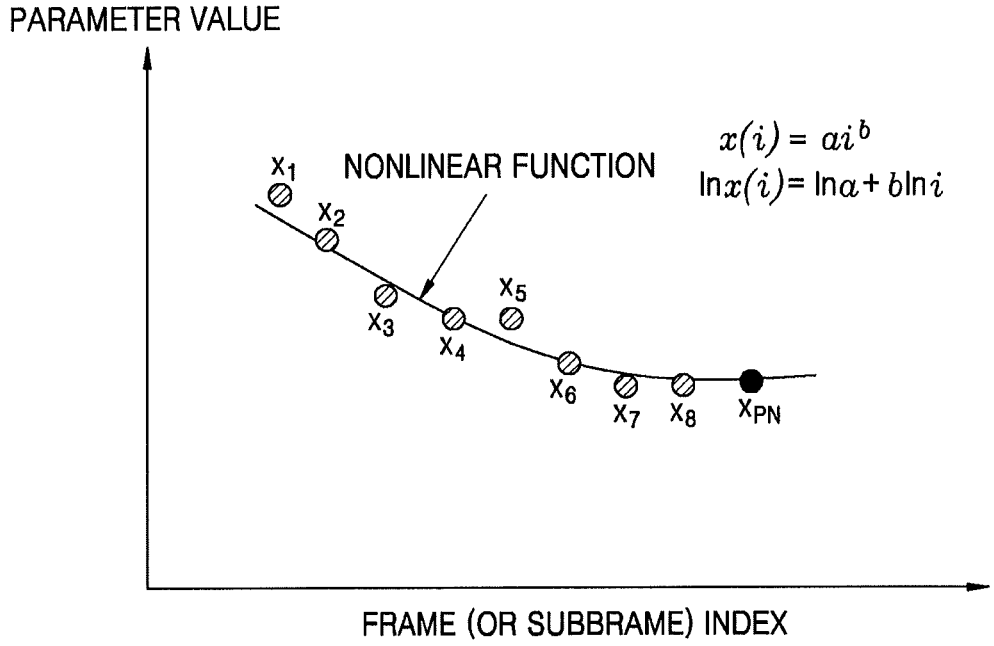
FIG. 4B illustrates a graph showing an example of a function derived by a nonlinear regression analysis according to an embodiment of the present invention.

Examples of derived functions are shown in FIGS. 4A and 4B. FIG. 4A illustrates an example of deriving a linear function x(i)=ax+b from parameter values (x1, x2, x8) of a PGF. FIG. 4B illustrates an example of deriving a nonlinear function $x(i)=ai^b$ from parameter values (xi, x2, . . . , $x_8$) of a PGF.

Here, 'a' and 'b' are constants obtained by the regression analysis.

The first parameter prediction unit 220 predicts the gain parameter of the erased frame by using the function derived from the first function derivation unit 210 in operation S610. In FIG. 4A, the gain parameter ($Xp_L$) of the erased frame by the linear function and in FIG. 4B, the gain parameter ($X_{PN}$) of the erased frame by the nonlinear function.

The gain control unit 230 controls the gain parameter with respect to the degree of voiced content of the PGF in operation S620. For example, when the predicted gain parameter of the erased frame is predicted according to a linear function, the gain controlled parameter ($^5$40) can be expressed as the following equation 1:

$$(i)=b \quad (1).$$

Here, a' is obtained according to the following equation 2:

$$a'=f(g_p(n), g_p(n-1), g_p(n-K))a \quad (2).$$

Here, f( )is a gain control function and plays a role of reducing the gradient a'when the degree of voiced content is high. And, $g_p(n)$, $g_p(n-1)$, $g_p(n-K)$ denote adaptive codebook gain parameters of the PGF.

By reducing the gradient a' when the degree of voiced content is high, serious reduction of the magnitude of the voice signal can be prevented. Accordingly, by the conventional method of reducing the gains of the PGB by a predetermined factor and replacing the adaptive codebook gain and fixed codebook gain, the voice can be restored close to the original voice.

The operation S620 may be omitted and operation S630 may be directly performed after the operation S610.

The first parameter prediction unit 220 or the gain control unit 230 provides the gain parameter as the gain parameter of the erased frame in operation S630.

Figure 3:
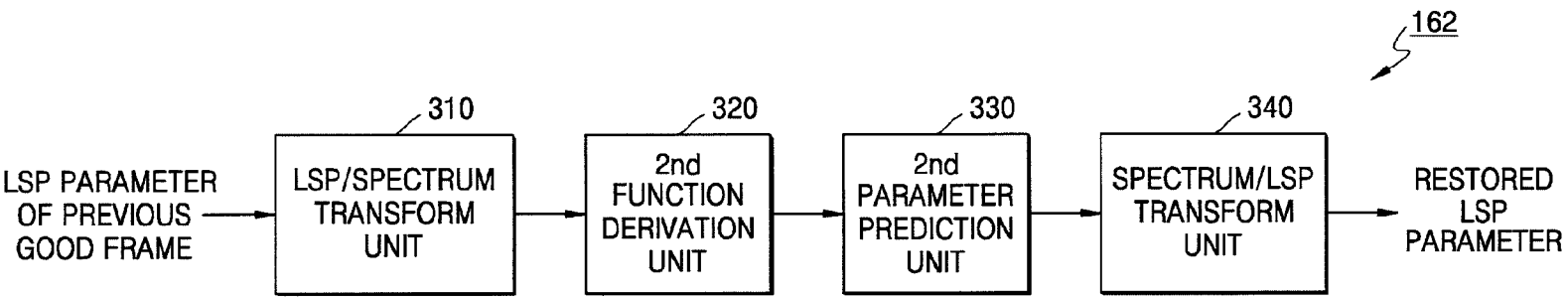
FIG. 3 is a detailed block diagram of the structure of the LSP restoration unit of FIG. 1.

FIG. 3 is a detailed block diagram of the structure of the LSP restoration unit 162.

Figure 7:
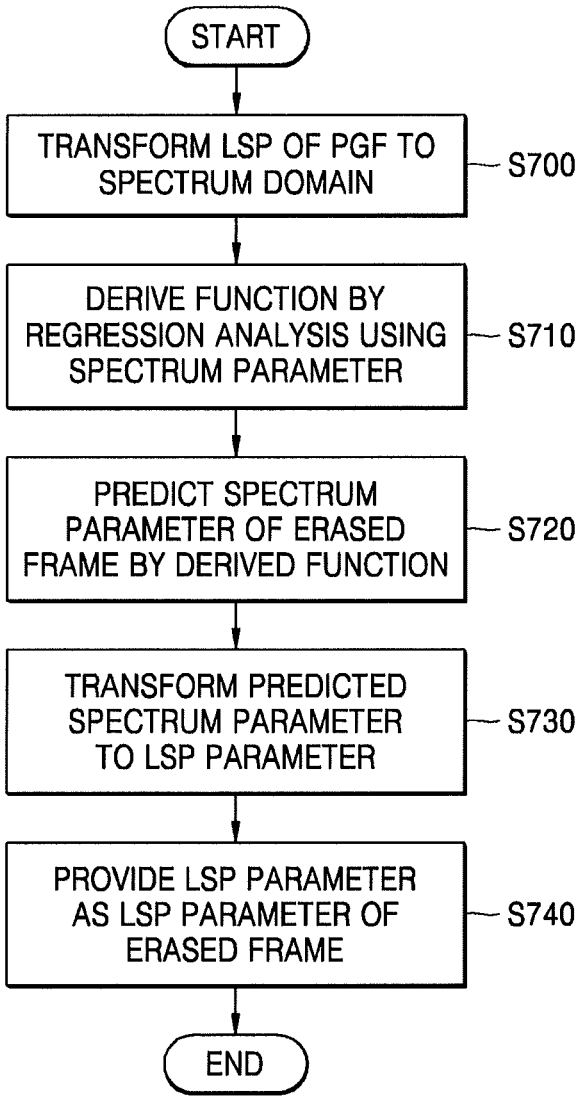
FIG. 7 is a detailed flowchart of the operation for restoring an LSP parameter shown in FIG. 5.

Referring to FIG. 3, the LSP restoration unit includes an LSP/spectrum transform unit 310, a second function derivation unit 320, a second parameter prediction unit 330, and a spectrum/LSP transform unit 340. The operation of the LSP restoration unit 162 shown in FIG. 3 will now be explained with reference to the flowchart showing in detail the operation of restoring an LSP parameter shown in FIG. 7.

The LSP/spectrum transform unit 310, if an LSP parameter having 10 roots of the PGF from the parameter extraction unit 110 is received, transforms the received LSP parameter into a spectrum domain and obtains a spectrum parameter in operation S700.

The second function derivation unit 320 derives a function by a regression analysis from the spectrum parameter of the PGF in operation S710. In the same manner as in the gain parameter, the derived function is a linear or nonlinear one. However, unlike the gain parameter, the LSP parameter has 10 roots and therefore a function is derived for each root.

The second parameter prediction unit 330 predicts the spectrum parameter of the erased frame by using the function derived in the second function derivation unit 320 in operation S720.

The spectrum/LSP transform unit 340 transforms the spectrum parameter of the erased frame into an LSP parameter in operation S730 and by outputting the LSP parameter to the LSP/LPC transform unit 140, provides the LSP parameter of the erased frame in operation S740.

Embodiments of the present invention include computer readable codes on a computer readable recording medium. A computer readable recording medium is any data storage deVice that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

According to the above-described embodiments of the present invention, by predicting and restoring the parameter of the erased frame through the regression analysis, the quality of the restored voice signal can be enhanced and the algorithm can be simplified. In particular, by quickly restoring an erased frame by using the previous parameter values, an excellent performance can be shown in real-time voice communication. Furthermore, by controlling the gain according to the degree of voiced content of the previous voice signal, degradation of the voice quality can be prevented.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A method for concealing frame erasure, the method comprising:

receiving a bitstream transmitted from an encoder;

predicting a first parameter of an erased frame of the bitstream, by performing a linear regression analysis on a second parameter obtained from a plurality of previous good frames;

obtaining a gain parameter between the first parameter of the erased frame and the second parameter;

concealing, by using a processor, the erased frame, by applying the gain parameter to a previous good frame from among the plurality of previous good frames; and generating a reconstructed sound signal based on the concealed erased frame.

2. The method of claim 1, wherein the first and second parameters comprise a spectral parameter.

* * * * *